US008792814B2

(12) United States Patent
Saiki et al.

(10) Patent No.: US 8,792,814 B2
(45) Date of Patent: Jul. 29, 2014

(54) RELEASING DEVICE, FIXING DEVICE AND IMAGE FORMING APPARATUS

(75) Inventors: Mikio Saiki, Saitama (JP); Shinichi Sakai, Saitama (JP); Yasuhide Saito, Saitama (JP); Takeshi Nakaoka, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 753 days.

(21) Appl. No.: 12/554,314

(22) Filed: Sep. 4, 2009

(65) Prior Publication Data

US 2010/0232847 A1 Sep. 16, 2010

(30) Foreign Application Priority Data

Mar. 10, 2009 (JP) ..... P2009-057036

(51) Int. Cl.
*G03G 15/20* (2006.01)

(52) U.S. Cl.
CPC ..... *G03G 15/2028* (2013.01)
USPC ..... 399/323; 399/122

(58) Field of Classification Search
CPC ..... G03G 15/2028
USPC ..... 399/122, 320–323
See application file for complete search history.

(56) References Cited

U.S. PATENT DOCUMENTS 5,528,345 A 6/1996 Hasegawa
7,133,633 B2 * 11/2006 Fukuda et al. ..... 399/323
7,474,871 B2 1/2009 Fujiwara
8,204,418 B2 * 6/2012 Nakajima ..... 399/323
2005/0013638 A1 1/2005 Fukuda et al.
2006/0008282 A1 * 1/2006 Aratachi et al. ..... 399/33
2009/0003897 A1 * 1/2009 Yamada ..... 399/323
2010/0221047 A1 * 9/2010 Nakajima et al. ..... 399/323

FOREIGN PATENT DOCUMENTS

CN 1722023 A 1/2006
JP Hei 8-6415 12/1996
JP 2003-122171 4/2003
JP 2007-108496 4/2007

OTHER PUBLICATIONS

Chinese Office Action (Application No. 200910176012.9), dated Oct. 24, 2013.

* cited by examiner

*Primary Examiner* — Walter L Lindsay, Jr.
*Assistant Examiner* — Jessica L Eley
(74) *Attorney, Agent, or Firm* — Morgan, Lewis & Bockius LLP

(57) ABSTRACT

A releasing device includes: a releasing unit that is made of a resin and disposed on a downstream side in a conveying direction of a recording medium from a fixing portion of a fixing unit which fixes a toner image on the recording medium, the releasing unit releasing the recording medium from the fixing unit; a supporting unit that supports the releasing unit on a supporting face and maintains the releasing unit and the fixing unit in a non-contact state; a screw that is advanced in a direction along the supporting face to secure the releasing unit; and a protruding portion provided between the releasing unit and the supporting unit and disposed at a position in a range extending from a first region between the screw and the supporting face to a second region shifted from the first region in a tightening direction side of the screw.

11 Claims, 13 Drawing Sheets

RELEASING DEVICE, FIXING DEVICE AND IMAGE FORMING APPARATUS

CROSS-REFERENCE TO RELATED APPLICATION

This application is based on and claims priority under 35 USC 119 from Japanese Patent Application No. 2009-057036 filed Mar. 10, 2009.

BACKGROUND

1. Technical Field

The present invention relates to a releasing device, a fixing device and an image forming apparatus.

2. Related Art

An image forming apparatus wherein paper onto which a toner image is transferred is thermally compressed by a fixing device so that the toner image is fixed on the paper is provided with a releasing device to quickly release the paper after the fixing process from the heating roll of the fixing device and to prevent the paper from winding around the heating roll.

The releasing device is provided with a releasing guide (an example of a releasing unit) that is installed so that a very small gap (for example, approximately 0.5 mm) is maintained between the tip of the releasing guide and the heating roll. The releasing device releases the paper having passed through a fixing portion formed between the heating roll and a pressure roll by scooping up the tip of the paper.

It is considered appropriate that the releasing guide, disposed close to the heating roll that is heated to a high temperature, should be made of metal having a small thermal deformation amount so that the above-mentioned gap is stably maintained. However, since the releasing guide is disposed at a position that is located near a paper discharge port and might be touched by the user's hand when a paper jam is cleared, it is unfavorable that the releasing guide is made of metal and heated to a high temperature.

For these reasons, it is desirable that the releasing guide is made of resin instead of metal. However, in the case that the releasing guide is made of resin, the releasing guide is deformed locally and eventually makes contact with the heating roll, whereby image quality degradation occurs.

It is also considered that the releasing guide is made of resin and backed with sheet metal to suppress thermal deformation. However, in this case, a mechanism for maintaining the potential of the sheet metal at ground potential is required to prevent charging.

SUMMARY

According to an aspect of the invention, there is provided a releasing device, including:

a releasing unit that is made of a resin and disposed on a downstream side in a conveying direction of a recording medium from a fixing portion of a fixing unit which fixes a toner image on the recording medium, the releasing unit releasing the recording medium from the fixing unit after the toner image is fixed;

a supporting unit that supports the releasing unit on a supporting face of the supporting unit and maintains the releasing unit and the fixing unit in a non-contact state;

a screw that is advanced in a direction along the supporting face to secure the releasing unit to the supporting unit; and a protruding portion provided between the releasing unit and the supporting unit and disposed at a position in a range extending from a first region between the screw and the supporting face to a second region shifted from the first region in a tightening direction side of the screw.

BRIEF DESCRIPTION OF THE DRAWINGS

Exemplary embodiments of the present invention will be described in detail based on the following figures, wherein.

DETAILED DESCRIPTION

Figure 1:
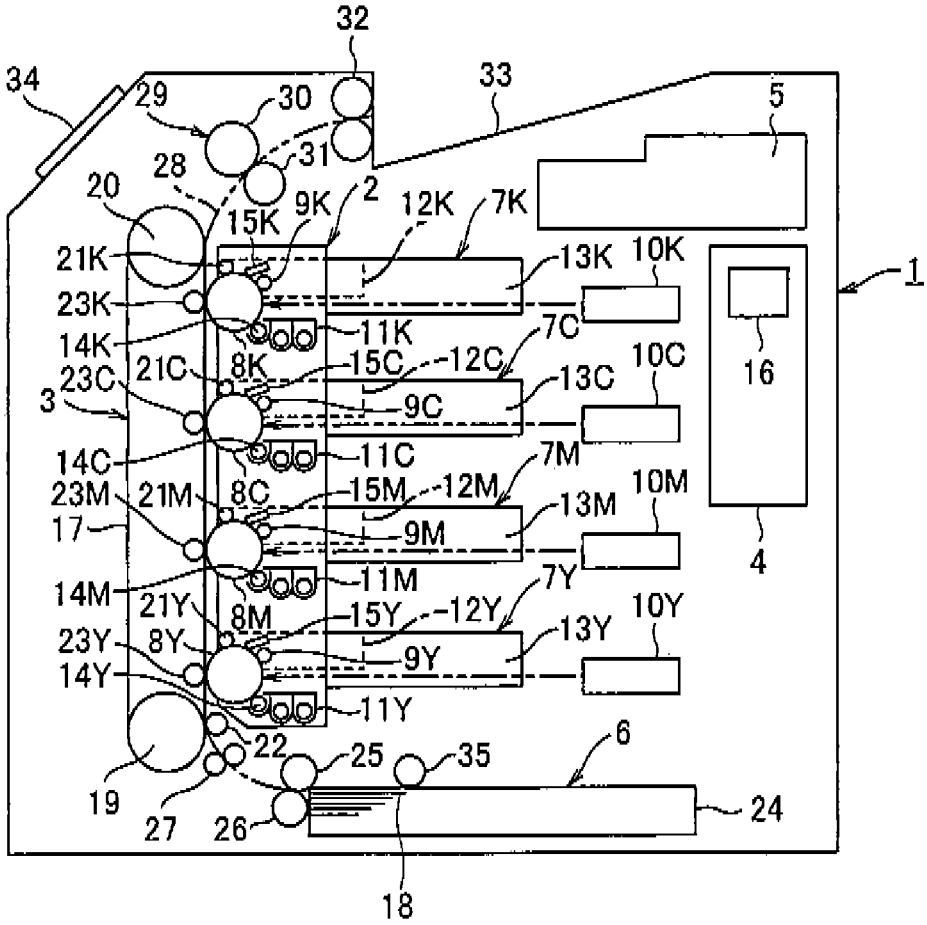
FIG. 1 is a conceptual view showing a tandem color printer serving as an image forming apparatus according to an exemplary embodiment of the present invention.

An exemplary embodiment as an example of the present invention will be described below in detail referring to the accompanying drawings. In the drawings for describing the exemplary embodiment, the same components are designated by the same reference codes in principle, and their repeated descriptions are omitted.

A color printer according to this exemplary embodiment is configured so as to perform printing on the basis of image data transmitted from a personal computer or a scanner, for example. The color printer serving as an image forming apparatus may be configured as a copier or a facsimile, each equipped with a scanner, or as a compound machine having the functions of these apparatuses, as a matter of course. Furthermore, the color printer may be a monochrome printer or a color printer other than a tandem type.

In FIG. 1, an image forming unit 2 is disposed in a vertical direction in an approximately central section inside a tandem color printer body 1. Furthermore, inside the color printer body 1, a paper conveying belt unit 3, for conveying paper (an example of a recording medium) to which a toner image having multiple colors and formed by the image forming unit 2 is transferred, in a sucked state, is disposed on one side of the image forming unit 2 (the left side in the case shown in FIG. 1). Moreover, a control unit 4 equipped with a control circuit, etc. is disposed on the other side of the image forming unit 2 (the right side in the case shown in FIG. 1), and a power source circuit unit 5 equipped with a high-voltage power source circuit, etc. is disposed obliquely above the image forming unit 2.

In addition, a paper cassette (sheet accommodating unit) 6 for accommodating paper 18 or the like as sheets on which images are transferred and formed and for feeding the paper is disposed at the bottom section inside the color printer body 1.

The image forming unit 2 is equipped with four image forming sections 7Y, 7M, 7C and 7K for forming toner images having the colors of yellow (Y), magenta (M), cyan (C) and black (K) in order from the bottom. These four image forming sections 7Y, 7M, 7C and 7K are disposed in series at constant intervals in a vertical direction.

The four image forming sections 7Y, 7M, 7C and 7K are all configured so as to be similar to one another except for the color of an image to be formed. Broadly speaking, as shown in FIG. 1, the four image forming sections each include a photosensitive drum 8 (8Y, 8M, 8C, 8K) serving as an image holding member rotating at a predetermined rotation speed, a charging roll 9 (9Y, 9M, 9C, 9K) for primary charging and for uniformly charging the surface of this photosensitive drum 8 to a predetermined electric potential, an exposing device 10 (10Y, 10M, 10C, 10K) for exposing an image corresponding to each color to form an electrostatic latent image on the surface of the photosensitive drum 8, a developing device 11 (11Y, 11M, 11C, 11K) for developing the electrostatic latent image formed on the photosensitive drum 8 using a toner having a corresponding color, a neutralizing device 21 (21Y, 21M, 21C, 21K) for removing charge remaining on the photosensitive drum 8 after development, a cleaning device 12 (12Y, 12M, 12C, 12K) for removing transfer residual toner remaining on the photosensitive drum 8, and a toner cartridge 13 (13Y, 13M, 13C, 13K) for supplying a toner to the developing device 11.

As shown in FIG. 1, the developing device 11 is configured so as to supply a two- or one-component developer accommodated inside the device to a developing roll 14 (14Y, 14M, 14C, 14K) while stirring the developer, to convey the developer to a developing region opposed to the photosensitive drum 8 while controlling the film thickness of the developer supplied to the developing roll 14 and to develop the electrostatic latent image formed on the surface of the photosensitive drum 8 using a toner of a predetermined color.

Furthermore, the toner cartridges 13Y, 13M, 13C and 13K serving as developer accommodating containers for supplying toners having colors of yellow (Y), magenta (M), cyan (C) and black (K) are provided for the corresponding developing devices 11Y, 11M, 11C and 11K for colors of yellow (Y), magenta (M), cyan (C) and black (K).

Moreover, the neutralizing device 21 irradiates light to the photosensitive drum 8, thereby removing residual charge after development, whereby the surface of the drum is uniformly charged in the next image forming process.

Still further, as shown in FIG. 1, the cleaning device 12 removes the transfer residual toner remaining on the surface of the photosensitive drum 8 using a cleaning blade 15 (15Y, 15M, 15C, 15K), conveys the removed transfer residual toner into the cleaning device 12 and accommodates the residual toner.

As shown in FIG. 1, the control unit 4 is disposed inside the color printer body 1 and equipped with an image processing device 16 for performing predetermined image processing on image data, for example. This image processing device 16 sequentially outputs image data for colors of yellow (Y), magenta (M), cyan (C) and black (K). The surfaces of the photosensitive drums 8Y, 8M, 8C and 8K are scanned and exposed respectively by four laser beams LB emitted from the exposing device 10 depending on the image data, and electrostatic latent images are formed. The electrostatic latent images formed on the photosensitive drums 8Y, 8M, 8C and 8K are developed as toner images having colors of yellow (Y), magenta (M), cyan (C) and black (K).

Furthermore, the paper conveying belt unit 3 is equipped with a paper conveying belt 17 that circulates and moves as an endless belt. The paper conveying belt unit 3 is configured so as to convey the paper 18 serving as a transfer material onto which the toner images having colors of yellow (Y), magenta (M), cyan (C) and black (K) and formed by the image forming sections 7Y, 7M, 7C and 7K are transferred in an electrostatically sucked state.

The paper conveying belt 17 is stretched between a driving roll 19 serving as a stretching roll and a driven roll 20 at a predetermined tension, the rolls being arranged in a vertical direction. The paper conveying belt 17 circulates and moves counterclockwise in FIG. 1 at a predetermined speed using the driving roll 19 that is rotated by a drive motor (not shown).

Although the distance between the driving roll 19 and the driven roll 20 is set to be nearly equal to the length of the paper 18 of A3 size, for example, the distance is not limited to this length, but may be set to an arbitrary value as a matter of course. Furthermore, for example, a synthetic resin film such as polyimide having flexibility and formed into the shape of an endless belt is used for the paper conveying belt 17.

Moreover, a suction roll 22 for causing the paper 18 to be sucked electrostatically on the surface of the paper conveying belt 17 is disposed so as to make contact with the surface of the driving roll 19 via the paper conveying belt 17. This suction roll 22 is formed, for example, by coating the surface of a metal core with conductive rubber, and a predetermined bias voltage for suction is applied to the metal core, as in the charging rolls 9 of the image forming sections 7Y, 7M, 7C and 7K. The suction roll 22 electrostatically charges the paper 18 fed from the paper cassette 6 so as to cause the paper 18 to be sucked on the surface of the paper conveying belt 17. However, it is not always necessary to provide the suction roll 22.

The toner images having colors of yellow (Y), magenta (M), cyan (C) and black (K) and formed on the photosensitive drums 8Y, 8M, 8C and 8K of the image forming sections 7Y, 7M, 7C and 7K are transferred sequentially and multiply in a state of being overlaid mutually using transfer rolls 23Y, 23M, 23C and 23K onto the paper 18 that is conveyed in a state of being sucked on the surface of the paper conveying belt 17 as shown in FIG. 1. The transfer rolls 23Y, 23M, 23C and 23K are integrally mounted on the paper conveying belt unit 3. Nip portions, in which the transfer rolls 23Y, 23M, 23C and 23K make pressure contact with the photosensitive drums 8Y, 8M, 8C and 8K, respectively, are used as image transfer regions in which the toner images are transferred onto the paper 18.

The paper 18 is fed from the paper cassette 6 disposed at the bottom section of the color printer body 1 and then conveyed to the color printer body 1 as shown in FIG. 1. The paper cassette 6 is equipped with a paper tray 24 accommodating the paper 18 having desired size and material quality. In addition, a pickup roll 35 adapted to nip a sheet of the paper 18 positioned uppermost is disposed directly above the paper tray 24. Hence, the paper 18 having desired size and material quality is delivered from the paper tray 24, one sheet at a time, using the pickup roll 35, fed using a feeding roll (feeding unit) 25, further fed in a state of being separated one sheet at a time using a separating roll 26, and then conveyed to a suction position on the paper conveying belt 17 at a predetermined timing using registration rolls 27 serving as a paper feeding unit.

The feeding roll 25 and the pickup roll 35 are provided on the side of the color printer body 1, and the separating roll 26 is provided on the side of the paper cassette 6.

A roll having a function in which the function of the pickup roll 35 and the function of the feeding roll 25 are combined may also be used. In addition, a pad-type separating unit having a predetermined frictional resistance on the paper 18 to be delivered may also be used instead of the separating roll 26.

As sheets, sheet-like members of various sizes, such as A4, A3, B5 and B4 sizes, and various materials, such as plain paper, thick paper (e.g. coated paper) and OHP sheets, are used.

The paper 18 onto which the toner images having colors of yellow (Y), magenta (M), cyan (C) and black (K) are multiply transferred is separated from the paper conveying belt 17 by virtue of the rigidity (the so-called stiffness) of the paper 18 itself and conveyed to a fixing device 29 along a conveying path 28 as shown in FIG. 1. Then, heat and pressure are applied to the paper 18 in the fixing device 29, whereby the toner images are fixed on the paper 18.

The paper conveying belt 17 and the fixing device 29 are disposed close to each other. The paper 18 separated from the paper conveying belt 17 is conveyed to the fixing device 29 by the conveying force of the paper conveying belt 17. The fixing device 29 is configured so that a heating roll 30 and a pressure belt 31 constituting a fixing unit 29*a* are rotated in a state of making pressure contact with each other, and the paper 18 is passed through a fixing portion P formed between the heating roll 30 and the pressure belt 31, whereby fixing is performed by the heat and pressure.

Then, the paper 18 on which the toner images having the respective colors are fixed is discharged in a state that the printed side thereof faces down by a pair of discharge rolls 32 from a discharge port onto a discharge tray 33 provided in the upper section of the color printer body 1, whereby printing is completed.

The color printer can print not only color images but also images having desired colors, such as monochrome. Hence, toner images are formed by all or some of the image forming sections 7Y, 7M, 7C and 7K for the colors of yellow (Y), magenta (M), cyan (C) and black (K) depending on the colors of images to be printed.

In FIG. 1, reference code 34 designates an operation panel equipped with a display section, such as a liquid crystal panel, installed on the front face of the color printer body 1. The operation panel 34 is configured so as to display the states of the printer and to perform necessary operations.

Next, the fixing device of the image forming apparatus having the general configuration described above will be described below.

Figure 2:
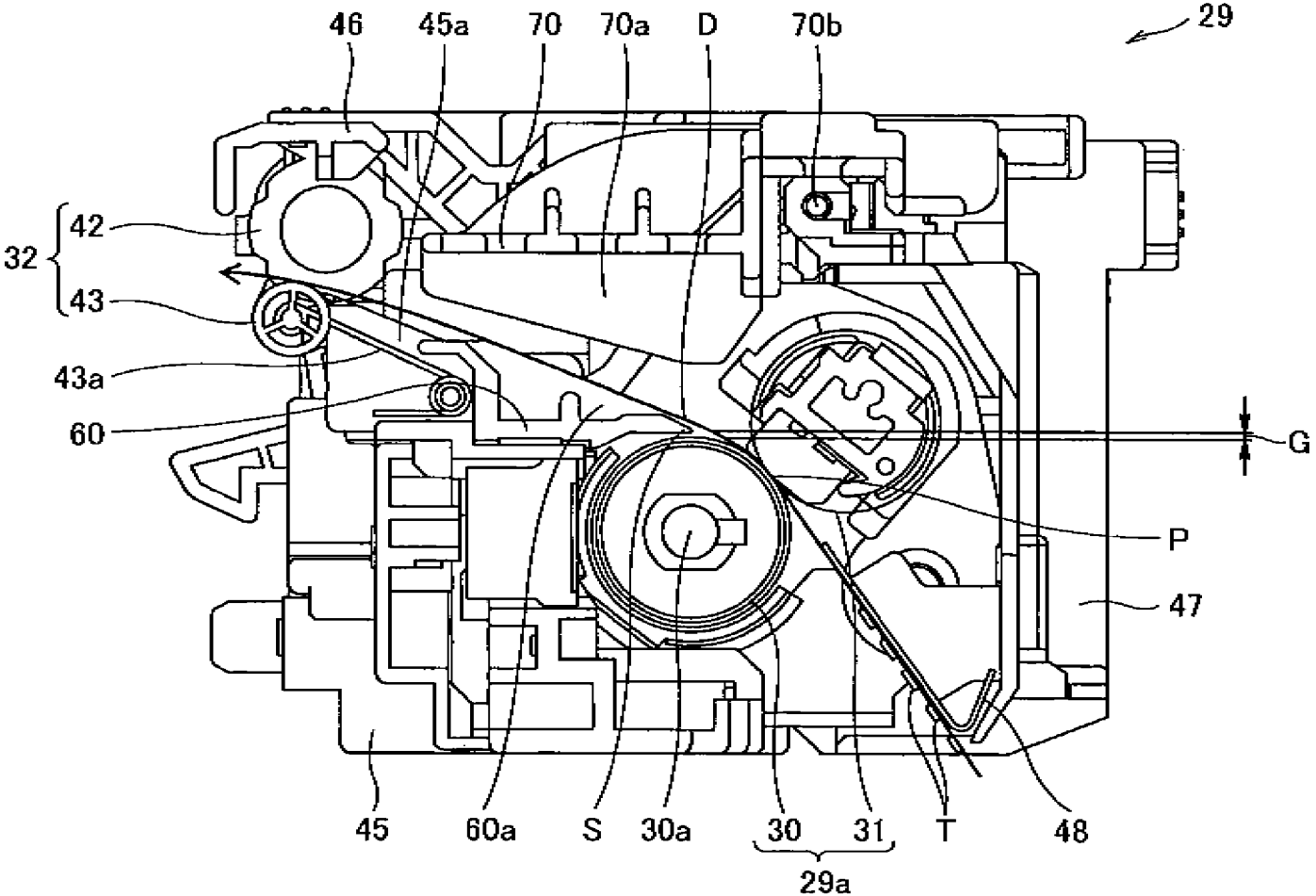
FIG. 2 is a sectional view showing a fixing device provided in the image forming apparatus according to the exemplary embodiment of the present invention.

In FIG. 2, the fixing device 29 is equipped with the heating roll 30 that is rotated by the rotation force of a rotating drive unit (not shown) and in which a heat source 30*a*, such as a halogen lamp, is installed, and is also equipped with the pressure belt 31 that is rotated while making pressure contact with the heating roll 30. The heating roll 30 and the pressure belt 31 are rotatably installed in the base 45 (an example of a supporting unit) (FIG. 7) and are covered with a cover panel 47 so as to be concealed. The heating roll 30 and the pressure belt 31 constitute the fixing unit 29*a* according to the present invention as described above.

When the paper 18, which is fed to the image transfer portion of the image forming unit 2 and onto which a toner image T is transferred, passes in a paper conveying direction D through the fixing portion P in which the heating roll 30 and the pressure belt 31 make pressure contact with each other, heat and pressure are applied to the paper 18, whereby the toner image T is fixed on the paper 18.

A guide plate 48 is disposed on the upstream side of the fixing portion P in the paper conveying direction D as shown in FIG. 2, whereby the paper 18 onto which the toner image T is transferred is smoothly guided to the fixing portion P. Furthermore, the paper 18 is conveyed while the face of the paper 18 on the side of the heating roll 30 is used as a face on which the toner image T is formed.

The discharge rolls 32 for discharging the paper 18 on which the toner image T is fixed onto the discharge tray 33 (FIG. 1) placed outside the color printer body 1 is disposed on the downstream side of the fixing portion P of the fixing device 29 in the paper conveying direction D. The discharge rolls 32 include a driving roll 42 that is rotated by the rotation force of a motor 40 and a driven roll 43 that is made pressure contact with the driving roll 42 by the spring force of a torsion spring 43*a* and rotated.

The driving roll 42 is installed inside a lid section 46 attached to the base 45 so as to be openable/closable for maintenance purposes and the like. When the lid section 46 is closed, the driving roll 42 engages the drive system of the printer and the outer circumferential face thereof makes pressure contact with the driven roll 43. When the rotation force of the driving roll 42 is transmitted to the driven roll 43, the driving roll 42 and the driven roll 43 cooperate to convey the paper 18.

A releasing guide (an example of a releasing unit) 60 for releasing the paper 18 on which the toner image T is fixed from (the heating roll 30) of the fixing unit 29*a* is disposed on the downstream side of the fixing portion P in the paper conveying direction D. Furthermore, a paper guide 70 is disposed at a position opposed to the releasing guide 60 with a paper conveying path (having the same direction as the paper conveying direction D) interposed therebetween.

The releasing guide 60, made of resin, is used to quickly release the paper 18 onto which the toner image T is transferred from the heating roll 30 making direct contact with the toner image T, thereby preventing the paper 18 from winding around the heating roll 30. A gap G of 0.46±0.1 mm, for example, is formed between the tip S of the releasing guide 60 and the heating roll 30. Examples of the resin constituting the releasing guide 60 include PET (polyethylene terephthalate), PBT (polybutylene terephtalate) and LCP (liquid crystalline polymer).

Hence, the tip of the paper 18 having passed through the fixing portion P formed between the heating roll 30 and the pressure belt 31 is scooped up on the tip S of the releasing guide 60 and released from the heating roll 30. Then, the paper 18 is guided into the space between the releasing guide 60 and the paper guide 70 and directed to the discharge rolls 32.

The releasing guide 60 should only be in a state of non-contact with the heating roll 30 of the fixing unit 29*a*, and the dimension of the gap G between the releasing guide 60 and the heating roll 30 is not limited to the value mentioned herein.

Figure 3:
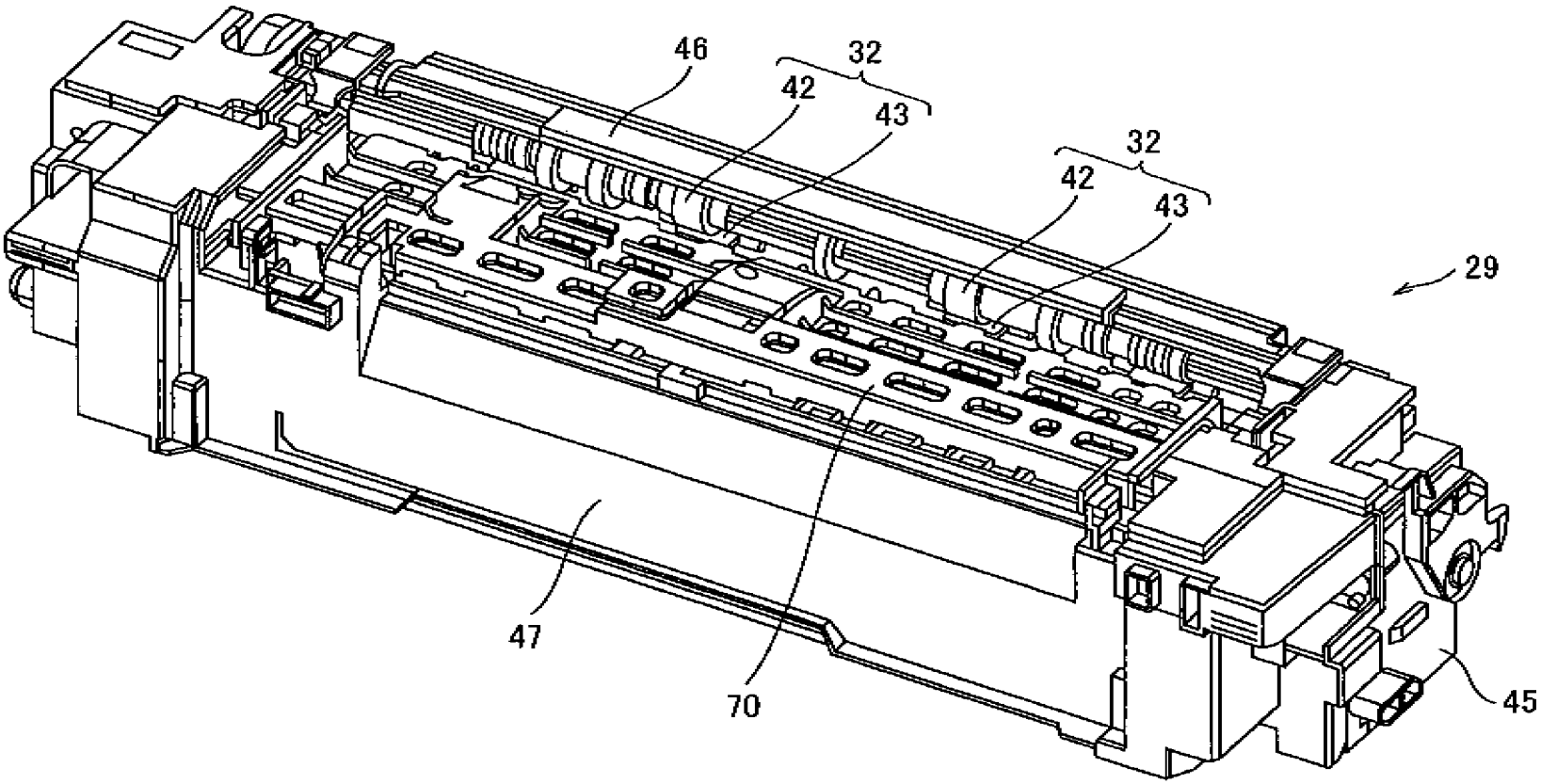
FIG. 3 is a perspective view showing the fixing device shown in FIG. 2.
Figure 4:
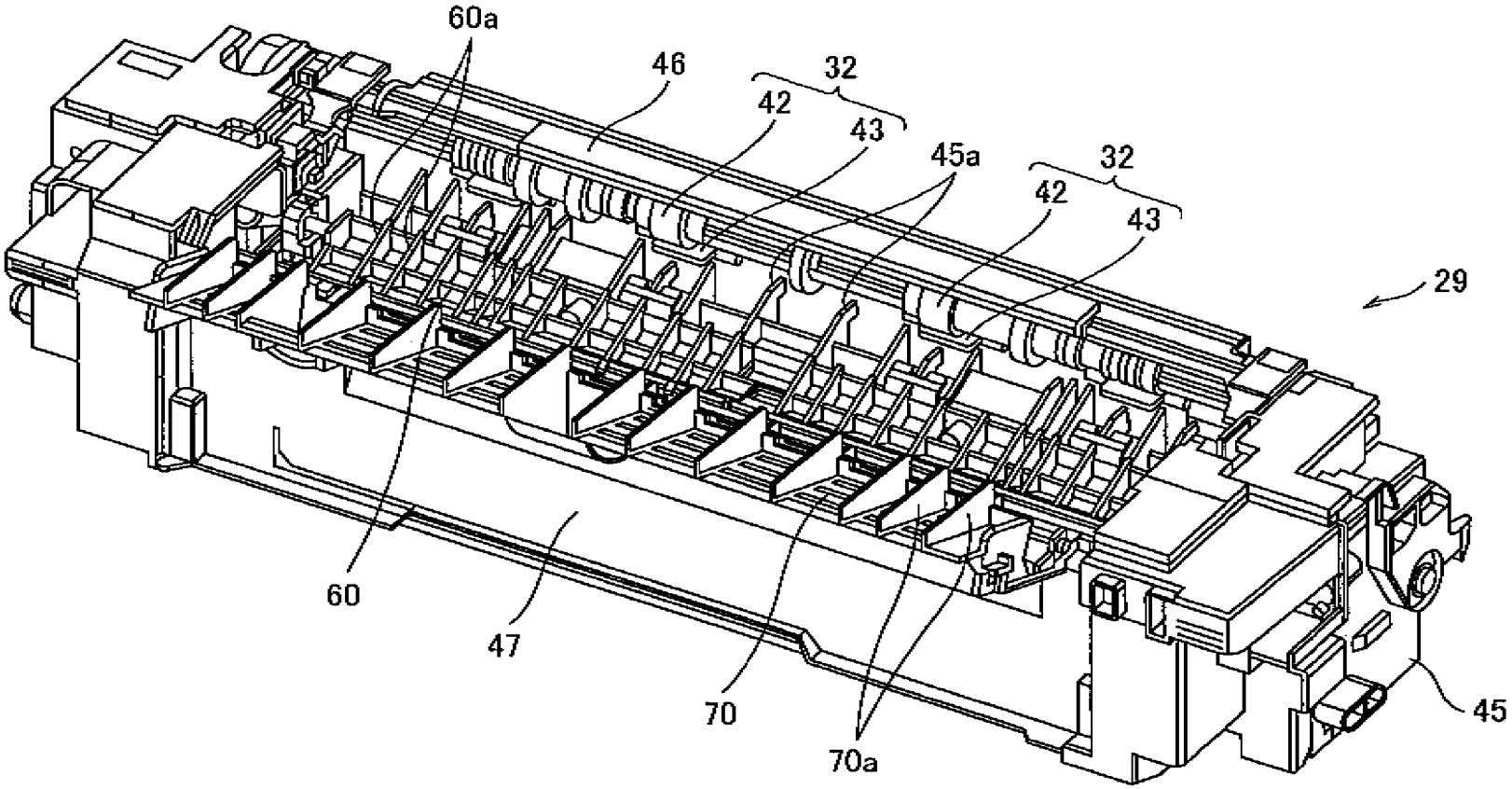
FIG. 4 is a perspective view showing the fixing device shown in FIG. 2, a paper guide being located at an open position.

As shown in FIGS. 3 and 4, the paper guide 70 moves to two positions, that is, a closed position (FIG. 3) opposed to the releasing guide 60 and an open position (FIG. 4) in which the releasing guide 60 is exposed, while the installation shafts 70*b* disposed at both ends of the base 45 in the longitudinal direction thereof and rotatably fitted in the base 45 are used as a fulcrum. Although the paper guide 70 is located at the closed position during normal operation, the paper guide 70 is located at the open position when the paper 18 is removed from the paper conveying path to clear a paper jam.

Figure 5:
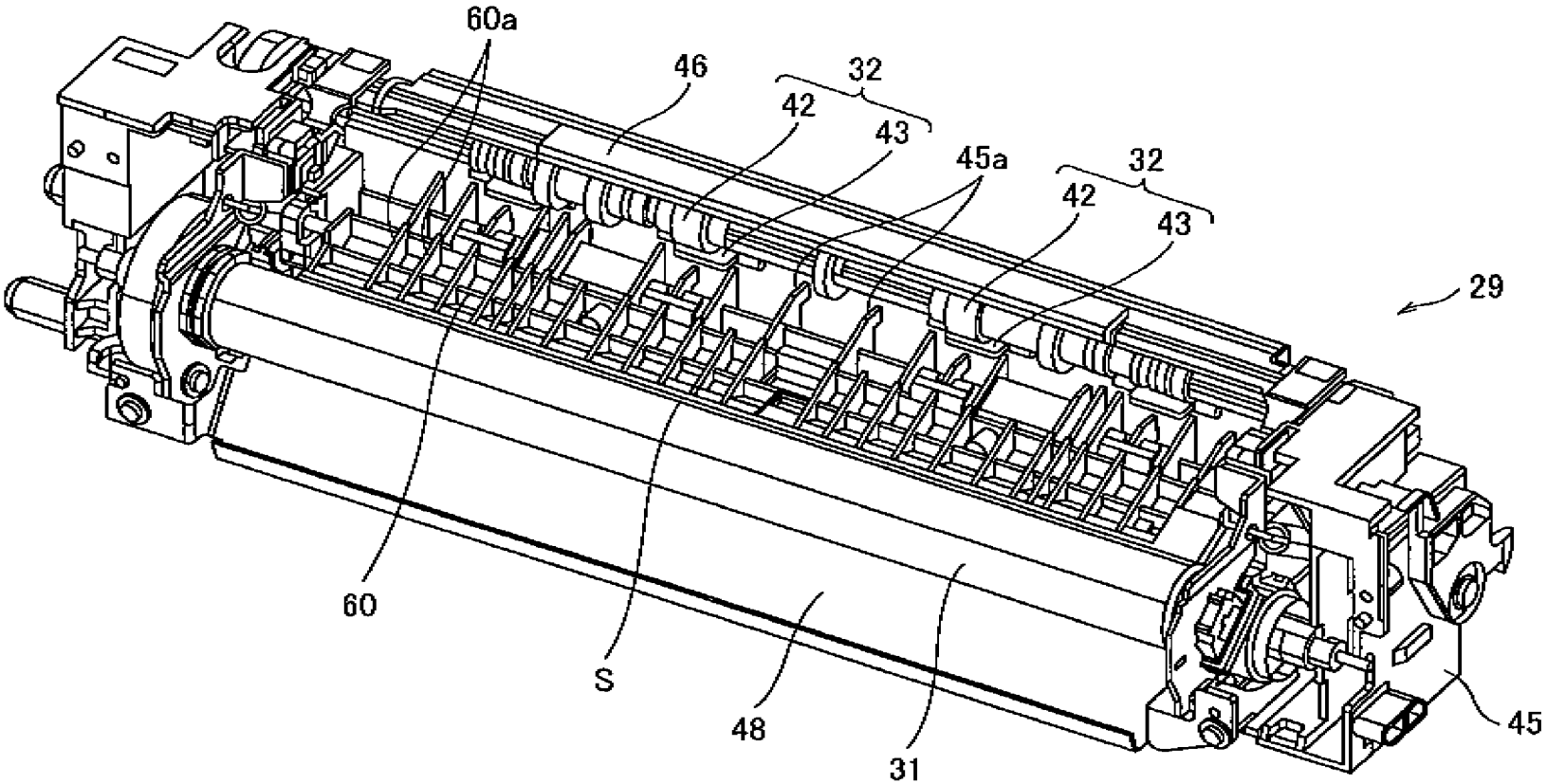
FIG. 5 is a perspective view showing the fixing device shown in FIG. 2, the paper guide and a cover panel being removed.
Figure 6:
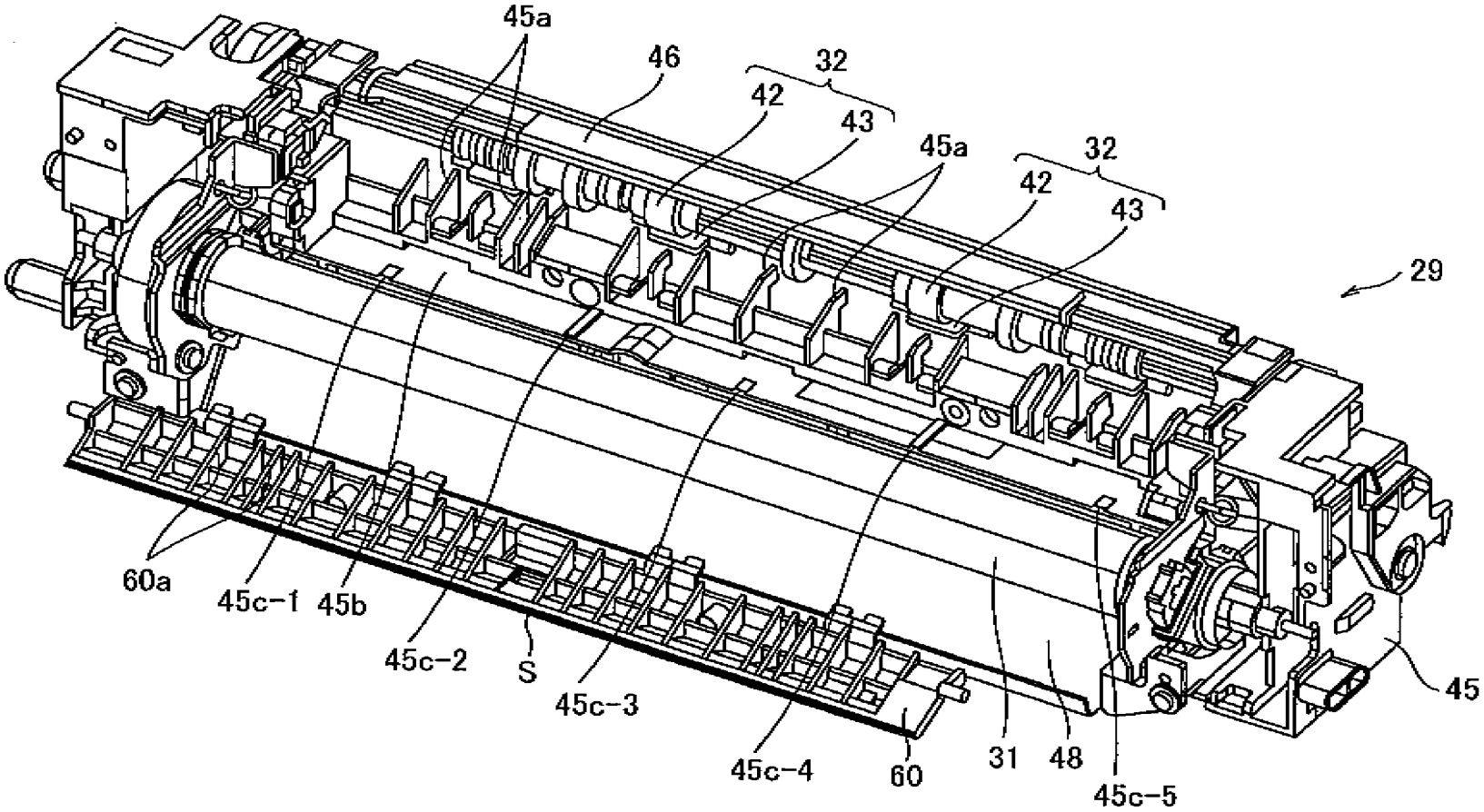
FIG. 6 is an exploded perspective view showing a state in which a releasing guide is removed from the fixing device shown in FIG. 5.

Ribs 45*a*, 60*a* and 70*a* are formed on the base 45, the releasing guide 60 and the paper guide 70, respectively, so as to face the paper conveying path. As shown in FIGS. 4, 5 and 6, the ribs 45*a*, 60*a* and 70*a* are formed along the paper conveying direction D to enhance the bending strengths of the releasing guide 60 and the paper guide 70 while reducing the conveying resistance of the paper 18 by partly making contact with the paper 18.

Figure 7:
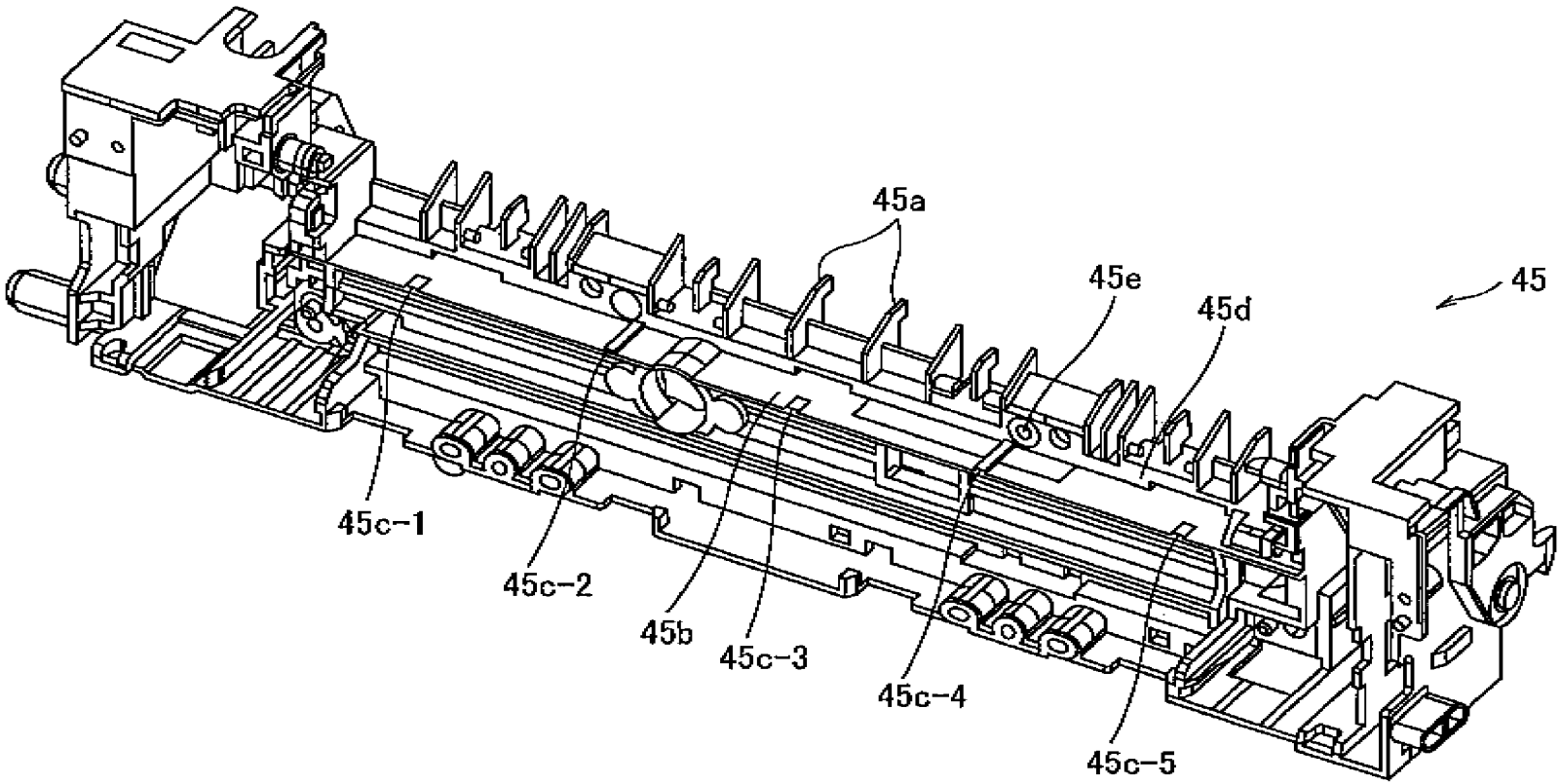
FIG. 7 is a perspective view showing a base serving as a component of the fixing device shown in FIG. 2.

The releasing guide 60 is installed on the base 45 (FIG. 7). As shown in FIG. 2, the releasing guide 60 is supported by the supporting face 45*b* formed on the base 45, whereby the releasing guide 60 (in particular, the tip S thereof) is prevented from lowering, and the above-mentioned gap G is maintained between the releasing guide 60 and the heating roll 30.

Five protruding portions 45*c* (45*c*-1 to 45*c*-5) are formed on the supporting face 45*b* of the base 45 so as to be positioned between the base 45 and the releasing guide 60. Hence, the releasing guide 60 is supported on the supporting face 45*b* in a state of being placed on these protruding portions 45*c*.

Figure 8:
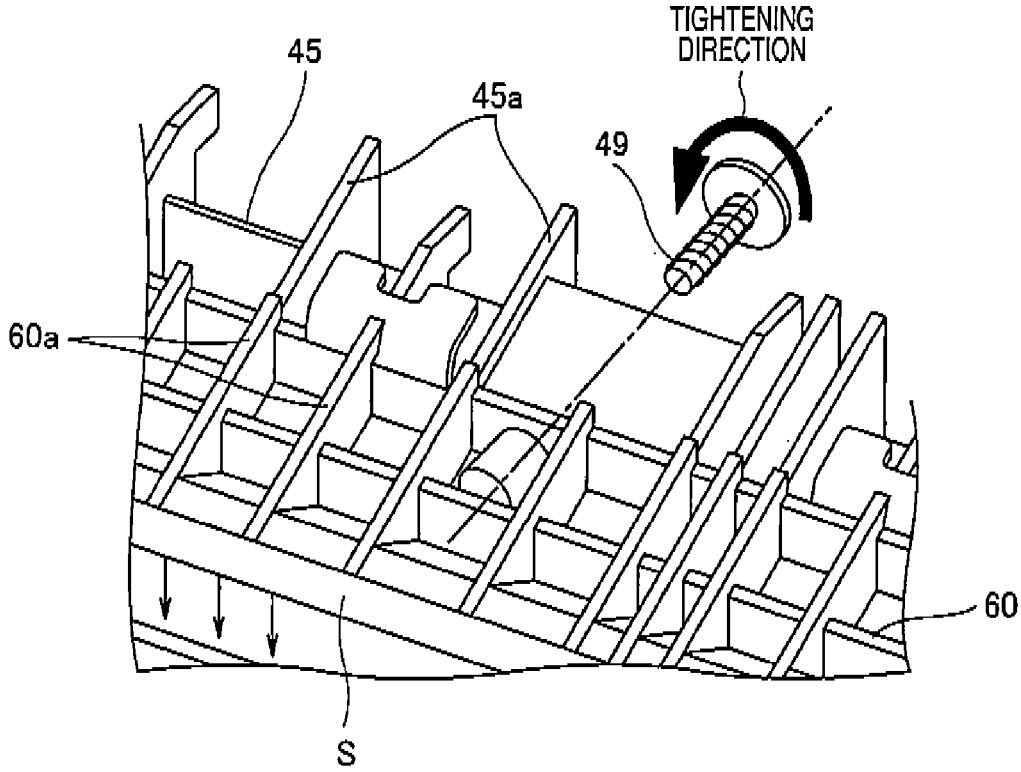
FIG. 8 is a perspective view showing a state in which the releasing guide is secured to the base with a screw.
Figure 9:
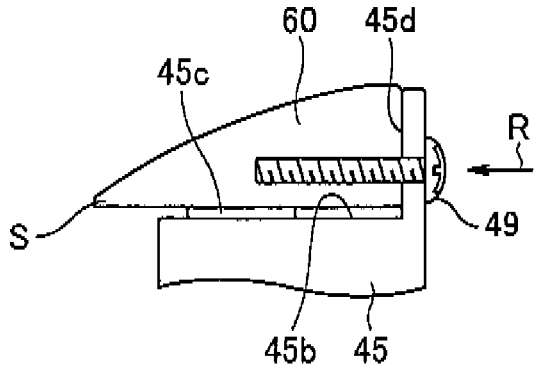
FIG. 9 is an explanatory view showing the positional relationship between the screw and the base.

The releasing guide 60 is installed so that the back face thereof positioned on the opposite side of the tip S makes face contact with the installation face 45*d* of the base 45 formed at approximately 90° with respect to the supporting face 45*b*. In other words, as shown in FIG. 7, a threaded hole 45*e* opening toward the releasing guide 60 is formed in the installation face 45*d*. The releasing guide 60 is secured to the base 45 by inserting a screw 49 into this threaded hole 45*e* and by fastening the releasing guide 60 with the screw 49 on the side of the back face (FIGS. 8 and 9).

The releasing guide 60, the base 45 and the screw 49 constitute a releasing device according to the exemplary embodiment.

Since the screw 49 is used to fasten the back face of the releasing guide 60 making face contact with the installation face 45*d* of the base 45, the axial direction of the screw 49 is approximately 90° with respect to the installation face 45*d*. Furthermore, since the supporting face 45*b* is formed approximately 90° with respect to the installation face 45*d*, the advancing direction R of the screw 49 is the direction along the supporting face 45*b*.

With this structure, stress concentration occurs at the tip S of the releasing guide 60 due to the tightening torque of the screw 49. Since the tip S of the releasing guide 60 is positioned close to the heating roll 30 and the releasing guide 60 is made of resin, the residual stress of the releasing guide 60 is relieved and the releasing guide 60 is deformed while the crystallization of the resin is advanced by heating using the heating roll 30.

Figure 10:
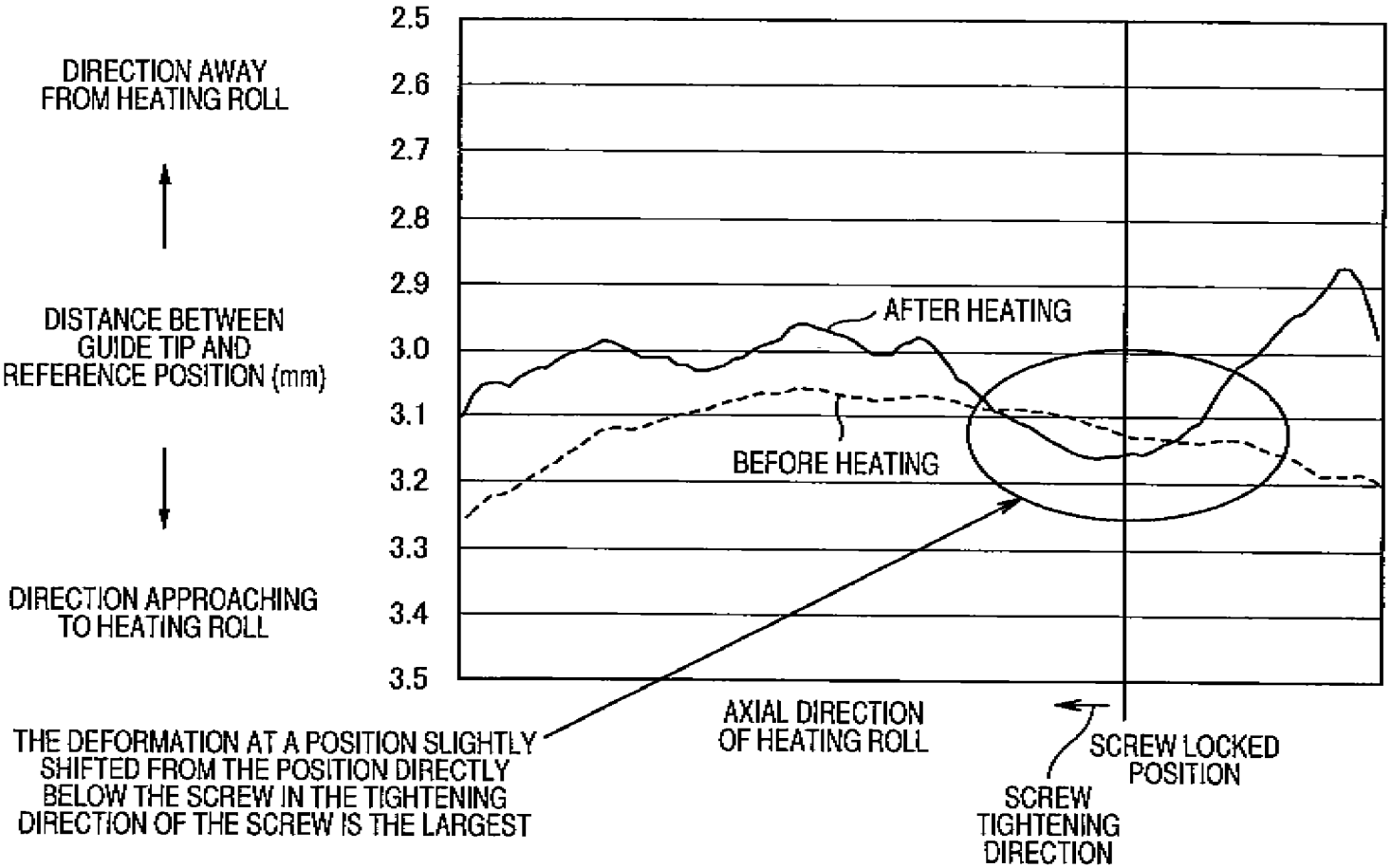
FIG. 10 is a graph showing the profile of the tip of the releasing guide before and after heating using a heating roll.

This deformation will be described below more specifically. As shown in FIG. 10, when the profile of the tip of the releasing guide 60 before heating using the heating roll 30 is compared with that after heating, the tip is significantly deformed toward the heating roll 30 after heating at the tightening position of the screw. When the deformation is observed more carefully, the position in which the amount of the deformation becomes the maximum is not the position directly below the screw but a position slightly shifted from the position directly below the screw in the tightening direction of the screw.

For this reason, the releasing guide 60 according to the exemplary embodiment is provided with a structure for canceling the deformation at the position in which the amount of the deformation becomes the maximum (in other words, the position slightly shifted from the position directly below the screw in the tightening direction of the screw).

Figure 11:
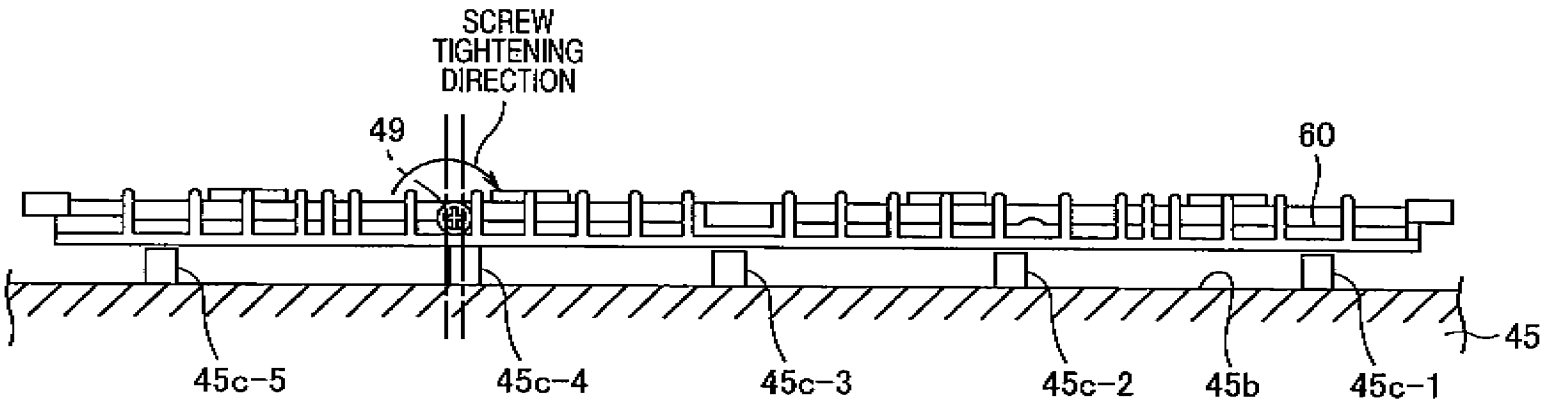
FIG. 11 is a view showing the base, the releasing guide and protruding portions, taken from the back face side of the releasing guide.
Figure 12:
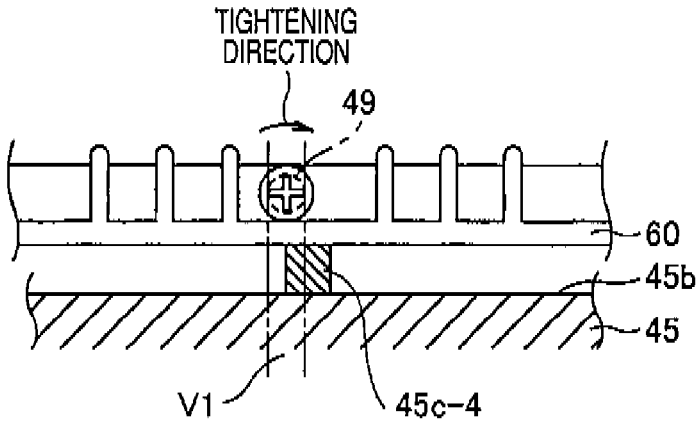
FIG. 12 is an explanatory view showing an example of the positional relationship among a protruding portion, the releasing guide and the screw, taken from the back face side of the releasing guide.

That is to say, as shown in FIG. 11, among the five protruding portions 45*c* provided on the base 45 as described above, the height of the protruding portion 45*c*-4 located near the screw 49 is set larger than those of the other protruding portions 45*c*-1 to 45*c*-3 and 45*c*-5 (for example, by approximately 0.2 to 0.3 mm). In addition, the protruding portion 45*c*-4 is not formed at the position directly below the screw 49, but is formed at the position slightly shifted in the tightening direction of the screw 49. The position slightly shifted in the tightening direction of the screw 49 is, for example, a position in a range extending from a region V1 between the screw 49 and the supporting face 45*b* of the base 45 to a region shifted from the region V1 in the tightening direction side of the screw 49 as shown in FIG. 12.

Figure 13:
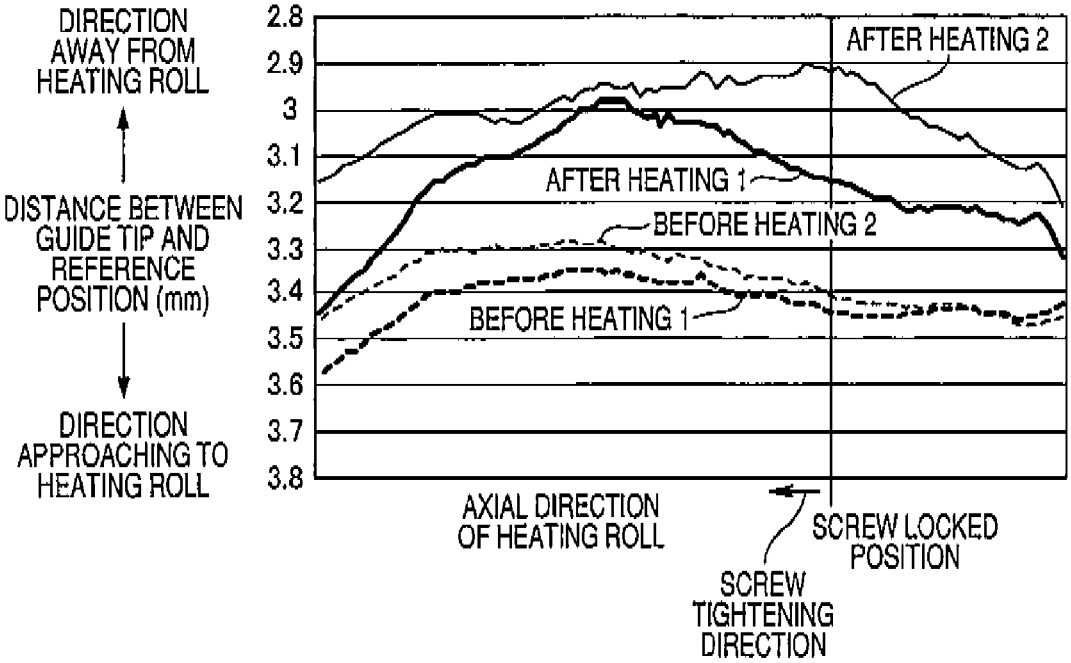
FIG. 13 is a graph showing the profile of the tip of the releasing guide before and after heating using the heating roll in the case that the protruding portion according to the exemplary embodiment is provided.

FIG. 13 shows the profile of the tip of the releasing guide 60 in the case that the protruding portion 45*c*-4 described above is provided, and also shows the measurement results of two samples. When the profile of the tip before heating using the heating roll is compared with that after heating, the phenomenon of the significant deformation toward the heating roll 30 at the tightening position of the screw after heating shown in FIG. 10 does not occur as shown in FIG. 13.

With the protruding portion 45*c*-4 provided as described above, significant thermal deformation is prevented even if the releasing guide 60 made of resin is heated using the heating roll 30, and the releasing guide 60 does not make contact with (the heating roll 30) of the fixing unit 29*a*.

Figure 14:
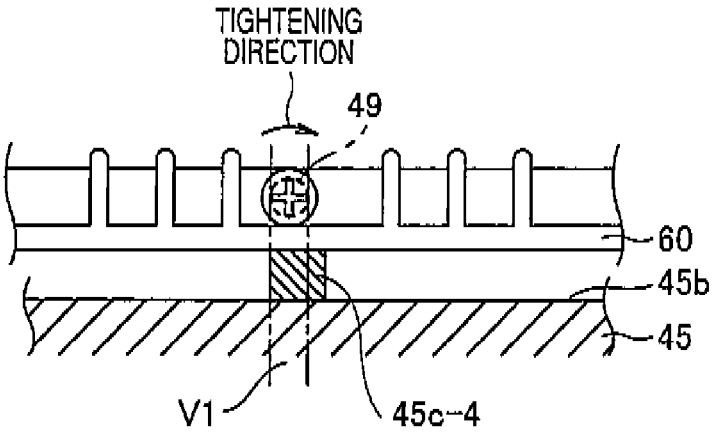
FIG. 14 is an explanatory view showing another example of the positional relationship among the protruding portion, the releasing guide and the screw, taken from the back face side of the releasing guide.

Since the position in a range extending from the region V1 between the screw 49 and the supporting face 45*b* of the base 45 to the region shifted from the region V1 in the tightening direction side of the screw 49 should only be a position within these regions, the protruding portion 45*c*-4 may be formed at a position in a range extending in the whole region V1 between the screw 49 and the supporting face 45*b* of the base 45 as shown in FIG. 14, for example. Furthermore, the protruding portion 45*c*-4 may also be formed at a position in a range extending to the region on the opposite side of the screw 49 in the tightening direction of the screw 49, provided that the region includes the above-mentioned region.

Figure 15:
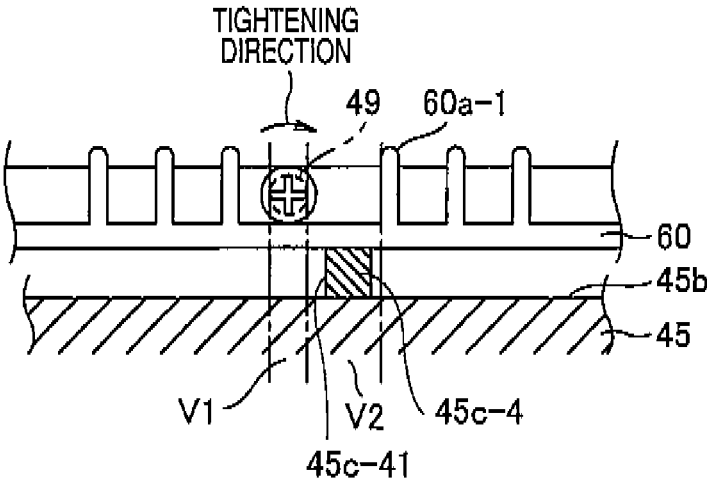
FIG. 15 is an explanatory view showing still another example of the positional relationship among the protruding portion, the releasing guide and the screw, taken from the back face side of the releasing guide.
Figure 16:
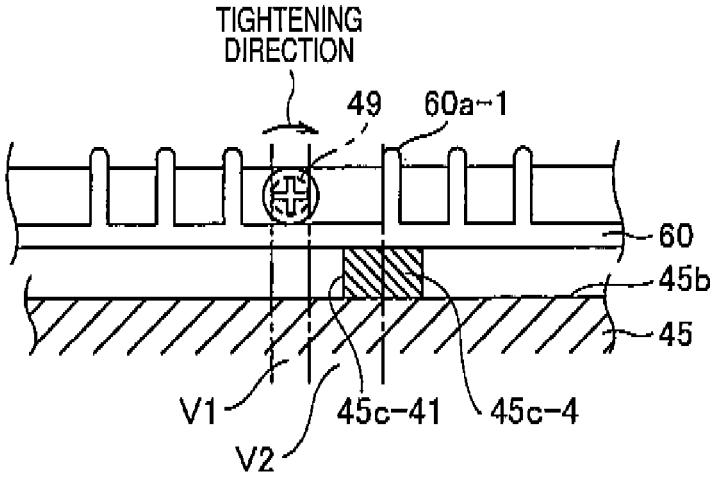
FIG. 16 is an explanatory view showing yet still another example of the positional relationship among the protruding portion, the releasing guide and the screw, taken from the back face side of the releasing guide.

Moreover, instead of the position in the region V1 between the screw 49 and the supporting face 45*b* of the base 45, the protruding portion 45*c*-4 may also be disposed at a position in a region V2 corresponding to the range between the screw 49 and a rib 60*a*-1 that is adjacent to the screw 49 on the side of the range in the tightening direction of the screw 49 as shown in FIG. 15.

Even in this case, the protruding portion 45*c*-4 is not required to be formed inside the region V2, but may be formed at a position in a range extending to the region opposite to the screw 49 side with respect to the region V2. In other words, the face 45*c*-41 of the protruding portion 45*c*-4 on the side of the screw 49 should only be positioned in a region corresponding to the region between the rib 60*a*-1 and the screw 49.

In the above description, the multiple (five in this case) protruding portions 45*c*-1 to 45*c*-5 are provided on the base 45, and the height of the protruding portion 45*c*-4 is set larger than those of the other protruding portions 45*c*-1 to 45*c*-3 and 45*c*-5. However, instead of setting the height of the protruding portion 45*c*-4 larger than those of the other protruding portions, it may be possible to provide the protruding portion 45*c*-4 only at the above-mentioned position slightly shifted in the tightening direction of the screw and not to provide protruding portions at the other positions.

Although the invention made by the inventors of the present invention has been specifically described on the basis of the exemplary embodiment, the exemplary embodiment disclosed is a mere example in all respects, and the present invention is construed not to be limited to the disclosed technology. In other words, the technical scope of the present invention is not to be interpreted limitedly on the basis of the descriptions of the above-mentioned exemplary embodiment but to be interpreted persistently according to the descriptions of the claims. The invention includes all modifications, provided that they do not depart from a technology equivalent to the technology according to the claims and the gist of the claims.

Although the protruding portions 45*c* are formed on the base 45 in the exemplary embodiment, the protruding portions 45*c* may also be provided on the side of the releasing guide 60, for example. In other words, the protruding portions should only be provided between the releasing guide and the base.

Furthermore, although the releasing device is provided inside the fixing device in the exemplary embodiment, the releasing device may be separated from the fixing device.

Although a case in which the releasing device according to the present invention is applied to an image forming apparatus for recording color toner images is described in the above description, the releasing device can also be applied to a monochrome image forming apparatus.

Moreover, various sheet-like materials, such as paper, film, postcards and paper currency, are applicable to the sheets to be conveyed.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A releasing device, comprising:

a releasing unit made of a resin and disposed on a downstream side in a conveying direction of a recording medium from a fixing portion of a fixing unit which fixes a toner image on the recording medium, the releasing unit configured to release the recording medium from the fixing unit after the toner image is fixed on the recording medium;

a supporting unit including a screw hole and a supporting face configured to support the releasing unit from below so as to maintain the releasing unit and the fixing unit in a non-contact state; and a screw screwed in the screw hole of the supporting unit in a direction along the supporting face of the supporting unit so as to secure the releasing unit to the supporting unit, wherein the supporting face includes a protruding portion on which the releasing unit is mounted from above, and the protruding portion is disposed at a position below the screw and shifted from the screw in a tightening direction of the screw, wherein the tightening direction is a direction in which the screw is rotated so as to be screwed in the screw hole.

2. The releasing device according to claim 1, wherein the supporting face includes a plurality of protruding portions in addition to the protruding portion of claim 1, wherein a height of the protruding portion of claim 1 is set larger than those of the plurality of protruding portions.

3. A fixing device, comprising: the releasing device according to claim 1.

4. An image forming apparatus, comprising: the fixing device according to claim 3.

5. A releasing device, comprising:

a releasing unit made of a resin and disposed on a downstream side in a conveying direction of a recording medium from a fixing portion of a fixing unit which fixes a toner image on the recording medium, the releasing unit having at least one rib formed along the conveying direction of the recording medium and configured to release the recording medium from the fixing unit after the toner image is fixed on the recording medium;

a supporting unit including a screw hole and a supporting face configured to support the releasing unit from below so as to maintain the releasing unit and the fixing unit in a non-contact state; and a screw screwed in the screw hole of the supporting unit in a direction along the supporting face of the supporting unit so as to secure the releasing unit to the supporting unit, wherein the supporting face includes a protruding portion on which the releasing unit is mounted from above, and the protruding portion is disposed at a position between the screw and a rib among the at least one rib, which is located adjacent to the screw in a tightening direction of the screw, wherein the tightening direction is a direction in which the screw is rotated so as to be screwed in the screw hole.

6. The releasing device according to claim 5, wherein a face of the protruding portion a side of the screw is positioned between the screw and the rib which is located adjacent to the screw.

7. The releasing device according to claim 6, wherein the supporting face includes a plurality of protruding portions in addition to the protruding portion of claim 6, wherein a height of the protruding portion of claim 6 is set larger than those of the plurality of protruding portions.

8. The releasing device according to claim 5, wherein the supporting face includes a plurality of protruding portions in addition to the protruding portion of claim 5, wherein a height of the protruding portion of claim 5 is set larger than those of the plurality of protruding portions.

9. A fixing device, comprising: the releasing device according to claim 5.

10. An image forming apparatus, comprising: the fixing device according to claim 9.

11. A releasing device, comprising:

a releasing unit that is made of a resin and disposed on a downstream side in a conveying direction of a recording medium from a fixing portion of a fixing unit which fixes a toner image on the recording medium, the releasing unit releasing the recording medium from the fixing unit after the toner image is fixed;

a supporting unit, including a screw hole, that supports the releasing unit and maintains the releasing unit and the fixing unit in a non-contact state;

a screw that is advanced in a direction along a supporting face to secure the releasing unit to the supporting unit via the screw hole;

a protruding portion provided between the releasing unit and the supporting face and disposed at a position in a range extending from a first region between the screw and the supporting face to a second region shifted from the first region in a tightening direction of the screw; and a plurality of protruding portions in addition to the protruding portion between the releasing unit and the supporting unit, wherein the tightening direction is a direction to which the screw is rotated, and wherein a height of the protruding portion is set larger than those of the plurality of protruding portions.

* * * * *